US006512424B2

(12) United States Patent
Furuya et al.

(10) Patent No.: US 6,512,424 B2
(45) Date of Patent: Jan. 28, 2003

(54) HIGH FREQUENCY NONRECIPROCAL CIRCUIT ELEMENT WITH A PROTRUDING EMBEDDED MAGNETIZED MEMBER

(75) Inventors: Mitsuru Furuya, Tokyo (JP); Osamu Myohga, Tokyo (JP); Yoshitsugu Okada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/834,539

(22) Filed: Apr. 13, 2001

(65) Prior Publication Data

US 2001/0024144 A1 Sep. 27, 2001

Related U.S. Application Data

(63) Continuation of application No. 09/317,057, filed on May 24, 1999, now Pat. No. 6,348,843.

(30) Foreign Application Priority Data

Jun. 3, 1998 (JP) ..... 10-154792

(51) Int. Cl.[7] ..... H01P 1/387

(52) U.S. Cl. ..... 333/1.1; 333/24.2

(58) Field of Search ..... 333/1.1, 24.2

(56) References Cited

U.S. PATENT DOCUMENTS

| | | | | |
|---|---|---|---|---|
| 3,101,456 A | * | 8/1963 | Brown, Jr. et al. | 333/1.1 |
| 3,359,510 A | * | 12/1967 | Geiszler | 333/1.1 |
| 4,471,329 A | | 9/1984 | Cavalieri d'Oro | 333/1.1 |
| H1408 H | | 1/1995 | Babbitt et al. | 333/1.1 |

* cited by examiner

*Primary Examiner*—Justin P. Bettendorf
(74) *Attorney, Agent, or Firm*—Katten, Muchin, Zavis, Rosenman

(57) ABSTRACT

A magnetic member 2 for nonreciprocal circuit is fitted in a first hole formed in a dielectric substrate 1 and at least one magnetic member 3 is fitted in a second hole formed in a portion of the dielectric substrate 1, which surrounds the first hole. An electrical conductor is printed on surfaces of the dielectric substrate 1 and the magnetic member 2 for nonreciprocal circuit to form a micro strip line 4. A grounding conductor 5 is formed on the other surface of the dielectric substrate 1. Changing the magnetization of the magnetic member 3 for frequency regulation can reversibly perform a regulation of the frequency characteristics of the nonreciprocal circuit.

16 Claims, 2 Drawing Sheets

HIGH FREQUENCY NONRECIPROCAL CIRCUIT ELEMENT WITH A PROTRUDING EMBEDDED MAGNETIZED MEMBER

CROSS REFERENCE TO RELATED APPLICATIONS

This application is a continuation of application Ser. No. 09/317,057, filed on May 24, 1999 now U.S. Pat. No. 6,348,843. The present invention claims priority from Japanese Patent Application No. 10-154792 filed Jun. 3, 1998, the contents of which are incorporated herein by reference.

BACKGROUND OF THE INVENTION

1. Field of the Invention

The present invention relates to an nonreciprocal circuit element such as a circulator and, particularly, to a high frequency nonreciprocal circuit element, which can be constructed as a high frequency integrated circuit or a microwave integrated circuit (MIC), fabricated by forming a plurality of circuit parts on a substrate. The high frequency nonreciprocal circuit element can be utilized in a communication device, radar equipment or a measuring instrument, etc. The present is preferably used in a high frequency circuit operable at a frequency higher than several GHz, particularly, exceeding 10 GHz.

2. Description of Related Art

A technology for constructing a buried ferrite type circulator by burying a ferrite disc in an alumina ceramics substrate and forming a predetermined conductor pattern on a surface thereof has been known. For example, Japanese Patent Application Laid-open No. Sho 61-288486 discloses a technique for forming a hole in a non-sintered sheet of low temperature sintered alumina material, burying a sintered ferrite in that hole and integrating the ferrite in the substrate by sintering it at low temperature.

This conventional technique is a useful technique for mounting ferrite part in a ceramic substrate. However, a regulation of a frequency characteristics of a resultant nonreciprocal circuit element requires manual operations such as trimming of a conductor portion formed on the substrate or regulation of a position of an external magnet fixedly mounted on a circular conductor portion.

On the other hand, a high frequency band exceeding 10 GHz has been utilized in various devices. Particularly, since the frequency in a 60 GHz band or a 70 GHz band is assigned to an operating frequency of an automobile radar equipment or a distance measuring instrument, a technique for mass-producing high frequency nonreciprocal circuit element which can be stably utilized in such frequency band and have a uniform characteristics at low cost is required. Further, the ferrite technology has been improved and hard ferrite which is low loss, generates a anisotropic magnetic field, which can be regulated, and has high coercive force becomes usable. When the frequency band to be utilized becomes higher than 10 GHz, the size of the element itself becomes smaller and, therefore, the above mentioned frequency regulation method of the element, which requires manual operations such as trimming of a conductor portion formed on the substrate or regulation of a position of an external magnet fixedly mounted on a circular conductor portion, is not always suitable in view of the mass-production, since the number of fabrication steps becomes large, the fabrication method becomes complicated and the characteristics of elements tend to be varied.

That is, when a high frequency nonreciprocal circuit element to be used in several tens GHz frequency band is designed as a macro wave integrated circuit, the size of a substrate thereof and the size of the conductor pattern become very small. In such small circuit, a slight size error influences the electric characteristics of a whole circuit largely and the regulation of frequency characteristics of the circuit after the fabrication thereof becomes indispensable. In the conventional techniques, there are problems that such regulation depends largely upon experience, so that it is not always suitable in fabricating uniform products, and that the reproducibility is low.

SUMMARY OF THE INVENTION

An object of the present invention is to provide a high frequency nonreciprocal circuit element, which can easily regulate frequency characteristics of a high frequency nonreciprocal circuit to be used in a high frequency band, and has uniform and stable electric characteristics.

According to a first aspect of the present invention, a high frequency nonreciprocal circuit element is featured by comprising a dielectric substrate formed with a plurality of holes, a magnetic member fitted in each of the holes for providing an nonreciprocal circuit, a magnetic member fitted in each of the holes for generating a magnetic field for regulating an operating frequency of the nonreciprocal circuit and a conductor printed on surfaces of the dielectric substrate and the nonreciprocal circuit.

The dielectric substrate may be of plastic material which is, preferably, polytetrafluoroethylene. A reinforcing plate may be provided on a rear surface of the dielectric substrate, for preventing mechanical deformation of the substrate. Alternatively, the dielectric substrate may be of ceramic.

The magnetic members to be mounted in the substrate, particularly, the magnetic member for frequency regulation, is preferably of hard ferrite in view of regulation of the frequency characteristics of the element.

According to a second aspect of the present invention, a frequency characteristics regulation method of the high frequency nonreciprocal circuit element is provided, in which the frequency regulation magnetic member is of hard ferrite and a magnetized state of the frequency regulation magnetic member is changed by externally applying a magnetic field to the magnetic member. Heating the magnetic member or applying a magnetic field while cooling it can easily change the magnetized state. That is, the change of magnetized state of the magnetic member can be effectively achieved by once demagnetizing the magnetic member by heating it up to Curie temperature of the material or higher and then magnetizing it by applying a magnetic field thereto while cooling it from that temperature. The change of the magnetized state can be executed while measuring the frequency characteristics of the high frequency nonreciprocal circuit element.

As another frequency characteristics regulation method, it is possible to mechanically remove a portion of the frequency characteristics regulation magnetic member. In such case, a height of the magnetic member is preliminarily set such that the magnetic member protrudes from the surface of the substrate and removing the protruded portion of the magnetic member regulates an amount of protrusion.

In a case where an organic material or plastic material is used for the substrate, the material is preferably polytetrafluoroethylene.

In a case where a ceramic substrate is used, the substrate is formed by forming a plurality of holes in a green sheet of the substrate before sintering, fitting magnetic members in the respective holes and sintering the green sheet at a temperature not higher than a temperature at which the magnetic members fitted in the holes are deformed and not lower than a sintering temperature of the green sheet. In the sintering step of the ceramic substrate, the magnetic members are fixedly fitted to the ceramic substrate by utilizing the shrinking nature of the holes. In this manner, it is possible to integrate a plurality of magnetic members to the ceramic substrate.

In a case where the magnetic member is of hard ferrite, the sintering of the green sheet of the ceramic substrate is performed at a temperature not higher than a sintering temperature of hard ferrite. Then, after the ceramic substrate is sintered, the magnetic members are magnetized by applying a magnetic field thereto when the temperature of the magnetic member becomes in the vicinity of Curie temperature or it becomes lower than Curie temperature. The sintering temperature of the ceramic substrate is 800° C. to 12000° C. Although Curie temperature of hard ferrite depends upon the kind of hard ferrite, it is usually about 400° C. to 7000° C. Further, the magnetization is regulated by regulating the magnetic field applied to hard ferrite. It is preferable to regulate the magnetization while monitoring the electric characteristics of the integrated circuit.

The formation of the holes in the ceramic substrate can be performed by punching the ceramic substrate which is in the state of green sheet. The magnetic members are fitted in the respective holes of the green sheet and, then, the green sheet is sintered. With the use of the punching in forming the holes, it is possible to easily and precisely set a mutual positional relation of the holes. Since there is the shrinkage of ceramic due to sintering, the mutual positional relation is regulated by performing test a plurality of times such that the final configuration after the sintering becomes a desired configuration. Once this regulation is completed, it is possible to fabricate a number of identical integrated circuits without necessity of performing configuration regulation individually.

The size of the holes to be formed in the green sheet is also regulated by performing test a plurality of times such that the magnetic members are suitably and rigidly fixed to the holes after the green sheet is sintered. Once this regulation is completed, it is possible to fabricate a number of identical integrated circuits.

The height of the magnetic member (length of the magnetic member in a perpendicular direction with respect to a surface of the ceramic substrate) is preferably the same as a thickness of the substrate or more.

In order to make the pressing force of the hole to the magnetic member uniform, it is most preferable to make the hole formed in the green sheet circular and to make at least a portion of the magnetic member, which becomes in contact with the substrate, a cylinder having a circular cross section. It is possible to make an outer configuration of the circuit part a cylinder having an ellipsoidal cross section. In such case, however, the number of tests for obtaining an optimal fixing of the magnetic member to the substrate may be increased.

The sintering temperature of the green sheet should be selected such that properties of the magnetic member, particularly, the hard ferrite member, is not changed at that temperature. However, according to tests conducted, it has been found that, even when the sintering is performed at a temperature not lower than Curie temperature of hard ferrite, a desired characteristics is obtained by lowing the temperature after the sintering is completed and applying a magnetic field to the hard ferrite to regulate the magnetic orientation thereof again when the temperature of the hard ferrite becomes lower than Curie temperature. Since the sintering temperature of hard ferrite and Curie temperature thereof depend upon the kind of hard ferrite, the temperature in the sintering step and the temperature in the magnetizing step are selected dependently upon the properties of hard ferrite to be used. It is not always necessary to set the sintering temperature to a temperature not lower than Curie temperature.

The magnetization of the hard ferrite after a completion of the sintering thereof may be performed when the temperature of a sample reaches room temperature. However, the magnetization of the hard ferrite to a desired value can be achieved easily by magnetizing it while lowering the temperature from a relatively high temperature. Further, it is possible to change the state of magnetization of a hard ferrite of the high frequency circuit, which is magnetized once, while measuring the characteristics of the high frequency circuit by electrically operating the high frequency circuit.

BRIEF DESCRIPTION OF THE DRAWINGS

An embodiment of the present invention will be described with reference to the accompanying drawings, in which.

DETAILED DESCRIPTION OF THE PREFERRED EMBODIMENTS

Figure 1C:
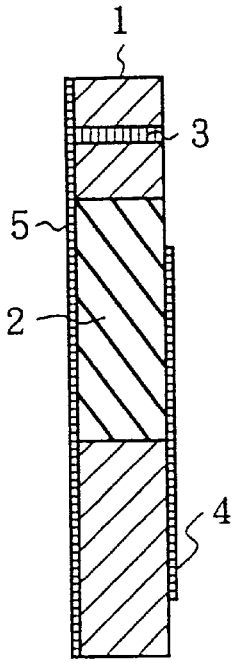
FIG. 1C is a cross sectional view of the high frequency nonreciprocal circuit element, taken along a line C—C in FIG. 1A.
Figure 1A:
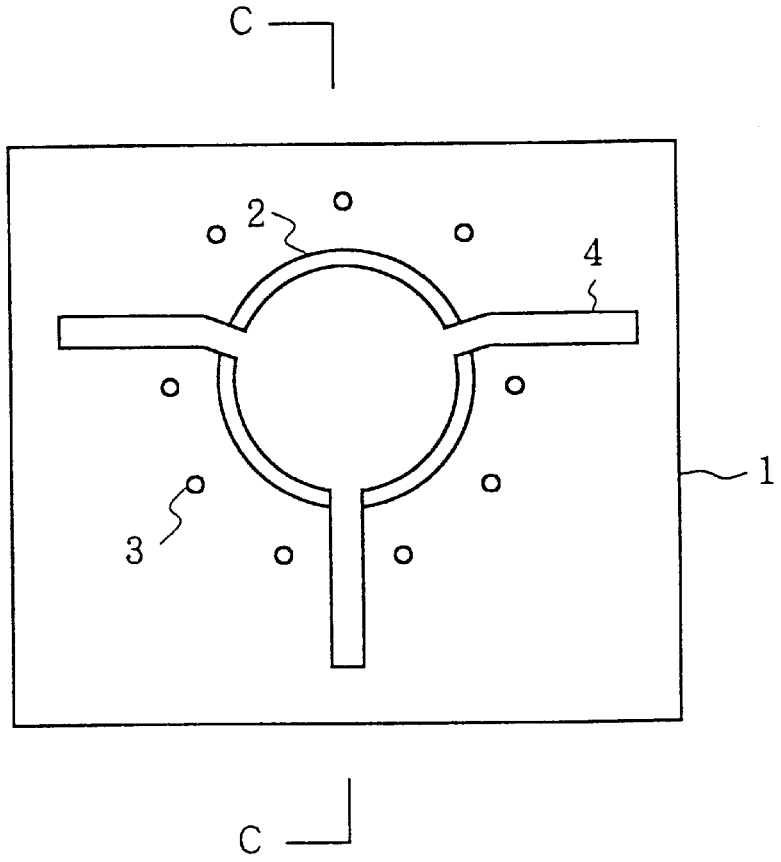
FIG. 1A is a plan view of a high frequency nonreciprocal circuit element according to an embodiment of the present invention.
Figure 1B:
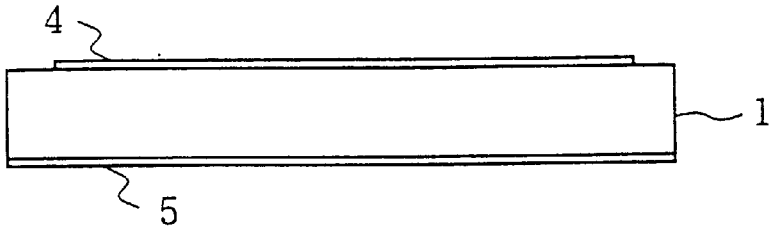
FIG. 1B is a front view of the high frequency nonreciprocal circuit element.

In FIG. 1A which is a plan view of a high frequency nonreciprocal circuit element according to an embodiment of the present invention, FIG. 1B which is a front view thereof and FIG. 1C which is a cross sectional view thereof taken along a line C—C in FIG. 1A, a substrate 1 is formed of ceramics having a size about 3 mm×3 mm×0.25 mm. The substrate 1 is formed with a relatively large hole and a plurality (9) of smaller holes surrounding the large hole. A magnetic member 2 for an nonreciprocal circuit is fitted in the large hole and a magnetic member 3 for frequency characteristics regulation is fitted in each of the small holes. A conductor is formed on surfaces of the substrate 1 and the magnetic member 2 by printing. The conductor is used as a micro strip line 4. A grounding conductor 5 is provided on the other surface of the substrate 1.

Figure 2:
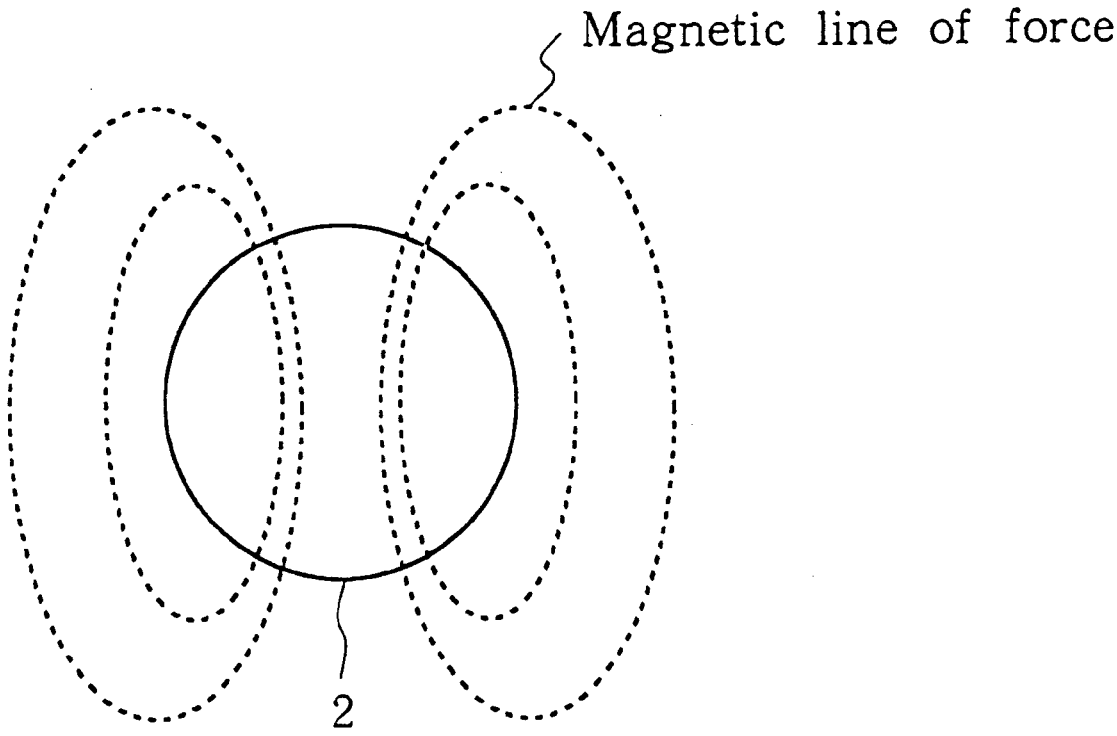
FIG. 2 illustrates a magnetic field distribution of a magnetic member used in the high frequency nonreciprocal circuit element of the embodiment of the present invention.

FIG. 2 illustrates a magnetic field distribution of the magnetic member 2 for nonreciprocal circuit when the high frequency nonreciprocal circuit element is in operation. Since the magnetic field generated by the magnetic member 2 for nonreciprocal circuit extends externally of the member as shown in FIG. 2, it is varied when the magnetic member 3 is positioned in a position within the magnetic field, the variation depending upon the magnetization of the magnetic member 3, and, as a result, the frequency characteristics of the high frequency nonreciprocal circuit element is changed.

Therefore, it is possible to regulate the frequency characteristics by changing the state of magnetization of the magnetic member by externally applying a magnetic field to the high frequency nonreciprocal circuit element constructed as shown in FIGS. 1A to 1C. Demagnetizing the magnetic member by increasing the temperature of the magnetic material up to a temperature not lower than Curie temperature thereof and then magnetizing it by applying a magnetic field while it is cooled gradually performs the magnetization. The state of magnetization of the magnetic member is changed while monitoring the frequency characteristics of the high frequency nonreciprocal circuit element.

It is possible to change the operating frequency characteristics of the high frequency nonreciprocal circuit element by simultaneously changing the states of magnetization of the magnetic members 2 and 3. However, when the change of the magnetization of the magnetic member 2 for nonreciprocal circuit influences the nonreciprocal characteristics of the high frequency nonreciprocal circuit element adversely, it is enough to change the state of magnetization of only the magnetic members 3 for frequency characteristics regulation. In such case, laser light may be used to heat the magnetic members 3 for frequency characteristics regulation.

Now, a method of fabricating the above mentioned high frequency nonreciprocal circuit element will be described. First, the hole 2 for the magnetic member 2 and the holes 3 for the magnetic members 3 are formed in a green sheet, which is a substrate before sintering, by punching. Then, the magnetic member 2 in the form of a circular cylinder is fitted in the hole 2 and the magnetic members 3 in the form of circular cylinders are fitted in the respective holes 3. The magnetic members 3 for frequency regulation are formed of hard ferrite. Thereafter, the green sheet is sintered at a temperature lower than the sintering temperature of hard ferrite. Further, the micro strip line 4 is formed by printing it with metal paste by using a printing mask and baking it.

After the sintering, the substrate is naturally cooled in air and, when the surface temperature of the substrate reaches about 6000° C., the magnetic members 3 are magnetized by applying a magnetic field to the magnetic members 3 while continuing the natural cooling. Alternatively, it is possible to magnetize the magnetic members 3 by applying the magnetic field to them individually. In such case, the magnetization of the magnetic members 3 is changed repeatedly such that the characteristics curve of the high frequency nonreciprocal circuit element becomes closest to a design value, while monitoring the frequency characteristics of the high frequency nonreciprocal circuit element.

In the high frequency nonreciprocal circuit element shown in FIGS. 1A to 1C, an organic material can be used as the material of the substrate 1. A fabrication method in such case will be described. First, a large hole having a diameter larger than that of the magnetic member 2 by 0.05 to 0.1 mm and small holes each having a diameter larger than that of the magnetic member 3 by 0.05 to 0.1 mm are formed in the organic substrate 1. Adhesive is painted on inner walls of the respective holes and the magnetic member 2 and the magnetic members 3 are fitted in the respective holes. Thereafter, a metal conductor 4 is formed on one surface of the substrate, plating, such that the metal conductor 4 and the respective parts become in a desired positional relation and, then, a grounding metal conductor 5 is formed on the opposite surface of the substrate to cover the whole surface.

Another fabrication method when an organic substrate 1 is used will be described. First, the magnetic member 2 and the magnetic members 3 are bonded to a surface of a metal foil by an electrically conductive adhesive or an electrically insulating adhesive. An organic resin is painted on the same surface of the metal foil to a thickness substantially equal to the height of the magnetic members and, then, the organic resin is hardened. Thereafter, the micro strip line 4 is formed on a surface of the organic resin layer by plating a metal conductor such that the metal conductor and the respective parts become a desired positional relation. The metal foil is used as the grounding conductor 5.

A further fabrication method when an organic substrate 1 is used will be described. First, a large hole having a diameter larger than that of the magnetic member 2 by 0.05 to 0.1 mm and small holes each having a diameter larger than that of the magnetic member 3 by 0.05 to 0.1 mm are formed in the organic substrate 1. On the other hand, the magnetic member 2 and the magnetic members 3 are bonded to a surface of a metal foil by an electrically conductive adhesive or an electrically insulating adhesive. The magnetic parts bonded to the metal foil are inserted into the respective holes of the substrate 1 and the metal foil is bonded to a surface of the substrate 1 by an adhesive. Thereafter, the micro strip line 4 is formed on the other surface of the substrate by plating a metal conductor such that the metal conductor and the respective parts become a desired positional relation. The metal foil is used as the grounding conductor 5.

As described hereinbefore, according to the present invention, it is possible, by forming the holes in the substrate, to integrate the magnetic member for nonreciprocal circuit element and the magnetic members for frequency characteristics regulation on a single circuit substrate with high mechanical precision. Therefore, it is possible to mass-produce the high frequency nonreciprocal circuit element having uniform characteristics in a several tens GHz band.

Further, by utilizing hard ferrite as the material of the magnetic members and regulating the magnetization thereof in a reversible manner, it becomes possible to regulate the frequency characteristics of the nonreciprocal circuit element after the latter is fabricated. Therefore, the yield of the products is improved and the frequency characteristics therefore can be regulated precisely.

What is claimed is:

1. A high frequency nonreciprocal circuit element comprising:

a dielectric substrate;

a first magnetic member fitted in a cylindrical first hole formed in said dielectric substrate and constructing a nonreciprocal circuit;

at least one second magnetic member fitted in a second cylindrical hole formed in a portion of said dielectric substrate surrounding said first hole and protruding from a surface of said dielectric substrate, said second magnetic member being externally applied with a magnetic field to change a magnetized state of said second magnetic member to enable said second magnetic member to regulate an operating frequency of said nonreciprocal circuit; and conductors having predetermined patterns and formed on surfaces of said dielectric substrate and said first magnetic member.

2. A high frequency nonreciprocal circuit element as claimed in claim 1, wherein a plurality of said second cylindrical holes are formed in said dielectric substrate and a plurality of said second magnetic members being of a cylindrical shape are respectively fitted in said second holes, said second magnetic members being smaller than said first magnetic member.

3. A high frequency nonreciprocal circuit element as claimed in claim 1, wherein said dielectric substrate is formed of a plastic material.

4. A high frequency nonreciprocal circuit element as claimed in claim 3, wherein said plastic material is polytetrafluoroethylene.

5. A high frequency nonreciprocal circuit element as claimed in claim 4, further comprising a grounding conductor provided on a rear surface of said dielectric substrate.

6. A high frequency nonreciprocal circuit element as claimed in claim 1, wherein said dielectric substrate is formed of a ceramic material.

7. A high frequency nonreciprocal circuit element as claimed in claim 1, wherein at least said second magnetic member is formed of hard ferrite.

8. A high frequency nonreciprocal circuit element of claim 1, wherein said at least one second magnetic member is smaller than said first magnetic member.

9. A high frequency nonreciprocal circuit element comprising:

a dielectric substrate;

a first magnetic member fitted in a first cylindrical hole formed in said dielectric substrate and constructing a nonreciprocal circuit;

at least one second magnetic member fitted in a second cylindrical hole formed in a portion of said dielectric substrate surrounding said first hole and protruding from a surface of said dielectric substrate, said second magnetic member being of a changeable magnetized state for regulating an operating frequency of said nonreciprocal circuit; and conductors having predetermined patterns and formed on surfaces of said dielectric substrate and said first magnetic member.

10. A high frequency nonreciprocal circuit element of claim 9, wherein said at least one second magnetic member is smaller than said first magnetic member.

11. A high frequency nonreciprocal circuit element of claim 9, wherein a plurality of said second cylindrical holes are formed in said dielectric substrate and a plurality of said second magnetic members being of a cylindrical shape are respectively fitted in said second holes, said second magnetic members being smaller than said first magnetic member.

12. A high frequency nonreciprocal circuit element as claimed in claim 9, wherein said dielectric substrate is formed of a plastic material.

13. A high frequency nonreciprocal circuit element as claimed in claim 12, wherein said plastic material is polytetrafluoroethylene.

14. A high frequency nonreciprocal circuit element as claimed in claim 13, further comprising a grounding conductor provided on a rear surface of said dielectric substrate.

15. A high frequency nonreciprocal circuit element as claimed in claim 9, wherein said dielectric substrate is formed of a ceramic material.

16. A high frequency nonreciprocal circuit element as claimed in claim 9, wherein at least said second magnetic member is formed of hard ferrite.

* * * * *